US011525426B2

(12) United States Patent
Ozono et al.

(10) Patent No.: US 11,525,426 B2
(45) Date of Patent: Dec. 13, 2022

(54) AIR CLEANER

(71) Applicants: HONDA MOTOR CO., LTD., Tokyo (JP); TIGERS POLYMER CORPORATION, Osaka (JP)

(72) Inventors: Miyuki Ozono, Saitama (JP); Shunsuke Watanabe, Hyogo (JP); Hiroaki Suwa, Hyogo (JP); Shunsuke Sakata, Hyogo (JP); Yoshikatsu Kakedai, Hyogo (JP)

(73) Assignees: HONDA MOTOR CO., LTD., Tokyo (JP); TIGERS POLYMER CORPORATION, Osaka (JP)

( * ) Notice: Subject to any disclaimer, the term of this patent is extended or adjusted under 35 U.S.C. 154(b) by 210 days.

(21) Appl. No.: 17/032,687

(22) Filed: Sep. 25, 2020

(65) Prior Publication Data

US 2021/0095622 A1 Apr. 1, 2021

(30) Foreign Application Priority Data

Sep. 27, 2019 (JP) ..... JP2019-176551

(51) Int. Cl.
*F02M 35/02* (2006.01)
*F02M 35/024* (2006.01)

(52) U.S. Cl.
CPC .... *F02M 35/0205* (2013.01); *F02M 35/0245* (2013.01); *F02M 35/02491* (2013.01)

(58) Field of Classification Search
CPC ..... F02M 35/0205; F02M 35/0245; F02M 35/02491; F02M 35/02433
See application file for complete search history.

(56) References Cited

U.S. PATENT DOCUMENTS 5,651,339 A * 7/1997 Weining ..... F02M 35/10019 123/184.53

FOREIGN PATENT DOCUMENTS

JP 2000-346687 12/2000
JP 2000346687 A * 12/2000

* cited by examiner

*Primary Examiner* — Jacob M Amick
*Assistant Examiner* — Charles J Brauch
(74) *Attorney, Agent, or Firm* — Wenderoth, Lind & Ponack, L.L.P.

(57) ABSTRACT

An air cleaner includes a case having an internal space, a filter element capable of partitioning the internal space into a first space and a second space, an intake port that introduces an air into the first space therethrough, an exhaust port that discharges an air from the second space, and at least one baffle part projecting toward the filter element from an inner surface of the case. The baffle part diffuses the air introduced into the first space and introduces the air to the filter element. The baffle part includes a widened baffle part. The widened baffle part includes a guide section extending along an extending surface of the filter element and a widened section larger in width than the guide section.

9 Claims, 10 Drawing Sheets

AIR CLEANER

CROSS REFERENCE TO RELATED APPLICATIONS

The present application claims priority under 35 U.S.C. § 119 to Japanese Patent Application No. 2019-176551 filed Sep. 27, 2019, the entire contents of which are hereby incorporated by reference.

BACKGROUND

Technical Field

This disclosure relates to an air cleaner for filtering and purifying air, or a structure thereof. In particular, this disclosure relates to an air cleaner for filtering and purifying the air to be fed to an internal combustion engine, or a structure thereof.

Related Art

Air cleaners which filter out dust from the air to purify the air are widely used in various applications, for example, internal combustion engines for motor vehicles such as motor cars and motorcycles, air conditioners, fuel cells, and air cooling systems for cells and electronic circuits. The air cleaners are to collect fine particles with high efficiency according to each application and are also to have characteristics that withstand a long-term use with less clogging.

A known example of air cleaners for automotive internal combustion engines is an air cleaner having a filter material in the form of a flat plate (a flat element). For example, Japanese Patent Application Laid-Open Publication No. 2000-346687 (JP 2000-346687 A) discloses an air cleaner having a filter material by which air is filtered. The air cleaner described in JP 2000-346687 A includes a cleaner element, a cleaner case that accommodates the cleaner element, and a diffusion plate that divides an intake flow. The inside of the cleaner case is partitioned by the cleaner element into a dirty-side space upstream of air flow and a clean-side space downstream of air flow. The dirty-side space is provided with an intake pipe coupled thereto, and the clean-side space is provided with an outlet pipe coupled thereto. The diffusion plate is disposed in the dirty-side space to divide an intake flow introduced through the intake pipe and guide the divided air to the cleaner element. The air that passed through the cleaner element flows out of the outlet pipe.

SUMMARY

However, the air cleaner described in JP 2000-346687 A has the diffusion plate extending in a direction intersecting with the direction (surface direction) in which the cleaner element extends. Thus, for example, when the distance between the cleaner element and an end of the diffusion plate extending toward the cleaner element is short, the air introduced through the intake pipe may be not guided homogeneously or uniformly to the cleaner element, resulting in inhomogeneous contamination of the cleaner element with dust or inhomogeneous dust distribution on the cleaner element.

The inventors made intensive studies to solve the above problem and finally found the following: a baffle part (or an air-guiding part) having a width larger in a section or portion away from the intake port than in a section or portion close to an intake port is provided on a surface of a case facing an extending surface of a filter element, and such a baffle part enables an air flow from the intake port to be diffused in a first space homogeneously or uniformly in a direction of the filter element and filtered and then to be discharged from a second space. That is, an air cleaner according to one aspect of this disclosure includes a case having an internal space, a filter element capable of partitioning the internal space into a first space and a second space, an intake port that introduces an air into the first space therethrough, an exhaust port that discharges an air from the second space, and at least one baffle part that projects or protrudes toward the filter element from an inner surface of the case and diffuses the air introduced into the first space and introduces the air to the filter element. The baffle part includes a widened baffle part including a guide section extending along an extending surface of the filter element and a widened section larger in width than the guide section.

The widened section may be disposed away from a center of the filter element and farther away from the intake port as viewed in a direction perpendicular to the extending surface.

The widened section may have a width increased at a greater distance from the intake port as viewed in a direction perpendicular to the extending surface.

The widened section may have a first side surface extending toward a direction intersecting with the extending surface and a second side surface opposite to the first side surface, and the first side surface and the second side surface may intersect with each other.

An angle between the first side surface and the second side surface may be 20° to 90°.

The widened section may branch as viewed in a direction perpendicular to the extending surface.

The widened baffle part may include a curved baffle part. The curved baffle part may be curved so as to be away from a hypothetical straight line connecting the intake port and the exhaust port as the curved baffle part extends from the intake port toward the exhaust port as viewed in a direction perpendicular to the extending surface.

The baffle part may further include a constant-width baffle part having a constant width.

At least part of the guide section, at least part of the widened section, or both may be hollow or solid.

At least part of the guide section, at least part of the widened section, or both may be in a rib form or a bead form.

DESCRIPTION OF EMBODIMENTS

Figure 1:
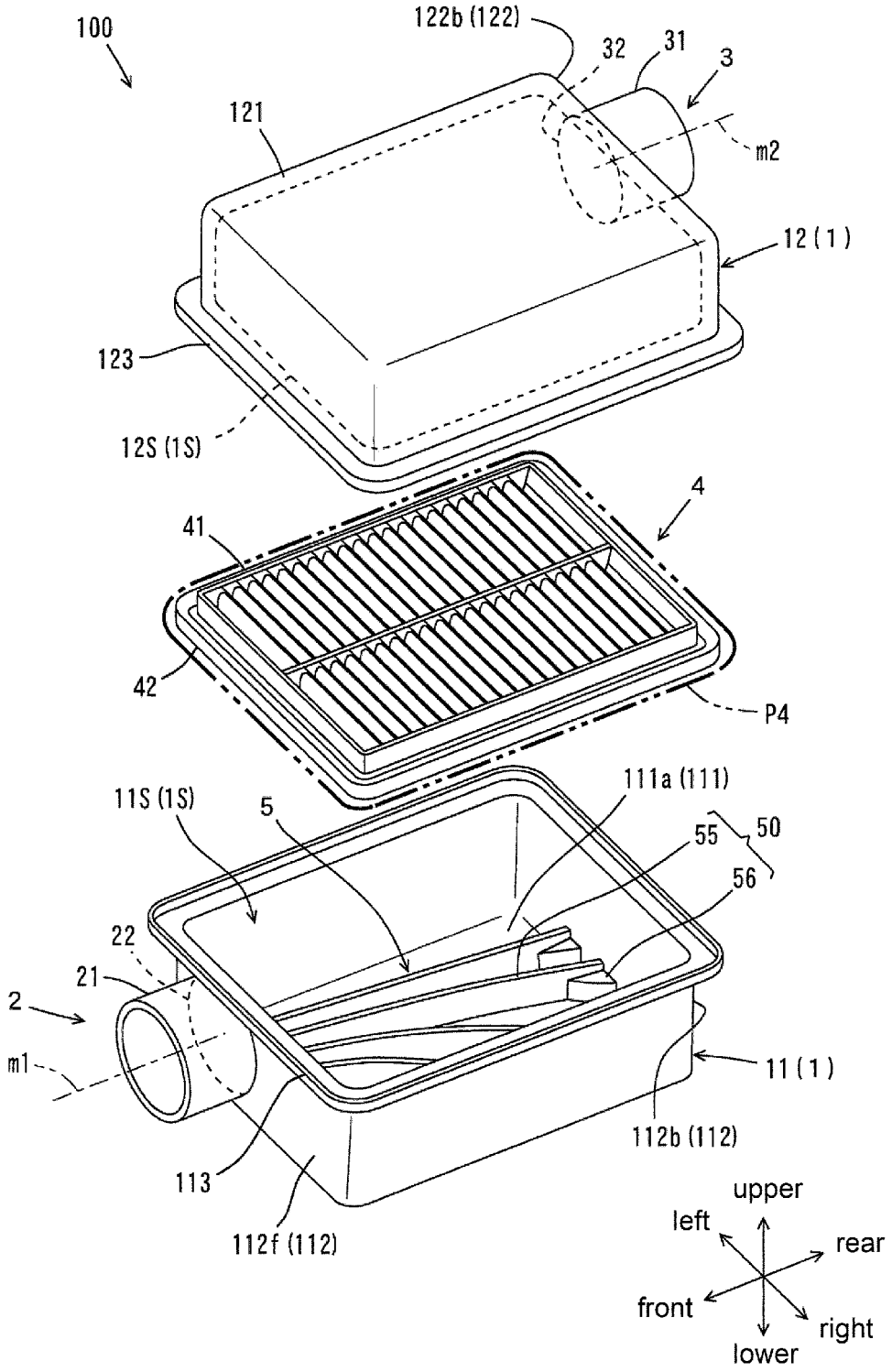
FIG. 1 is an exploded perspective view showing an air cleaner according to an embodiment of this disclosure.

Hereinafter, an air cleaner according to an embodiment of this disclosure will be described in detail with reference to the drawings. The air cleaner is used for, for example, a motor vehicle including a motor car and filters air to be supplied to an internal combustion engine of the motor vehicle. Hereinafter, the same reference numerals are used to refer to the same, similar or corresponding members or parts or components. As used herein, the term "substantially" refers to the complete or nearly complete extent or degree of an action, characteristic, property, state, structure, item, or result. As an arbitrary example, an object that is "substantially" enclosed would mean that the object is either completely enclosed or nearly completely enclosed. For example, the term "substantially parallel" means "parallel" or "substantially parallel".

Figure 2:
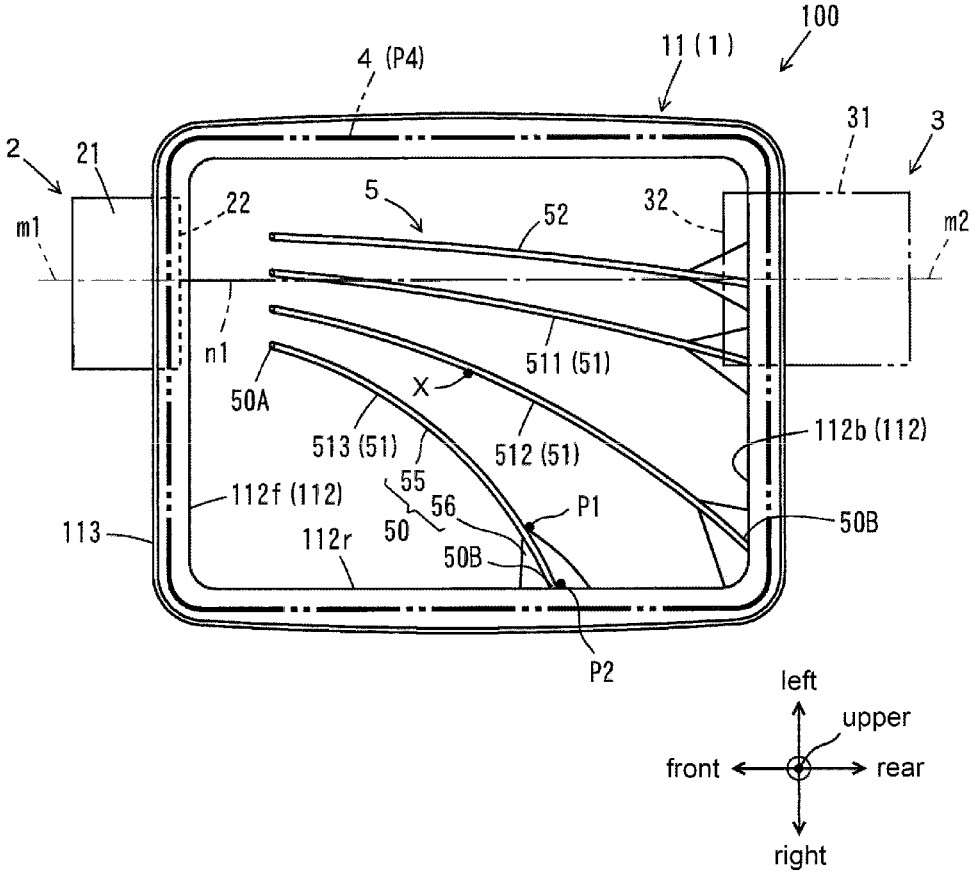
FIG. 2 is a plan view showing an upstream case according to the embodiment of this disclosure.

With reference to FIG. 1 and FIG. 2, an air cleaner 100 according to this embodiment will be described. FIG. 1 is an exploded perspective view showing the air cleaner 100 according to this embodiment. FIG. 2 is a plan view showing an upstream case 11 according to this embodiment. In FIG. 2, a narrow long dashed double-short dashed line shows an exhaust pipe 31 and an exhaust port 32, and a wide long dashed double-short dashed line shows a filter element 4.

As shown in FIG. 1, the air cleaner 100 includes a case 1 having an internal space 1S, and a filter element 4 capable of partitioning the internal space 1S into an upstream first space 11S and a downstream second space 12S. The filter element 4 has an extending surface P4 (a main surface). The extending surface P4 includes a direction in which the filter element 4 extends.

The case 1 includes the upstream case 11 and a downstream case 12. The first space 11S is a space defined by the upstream case 11 and the filter element 4. The second space 12S is a space defined by the downstream case 12 and the filter element 4.

The air cleaner 100 further includes an intake part 2 that introduces air into the first space 11S, and an exhaust part 3 for discharging the air taken in the internal space 1S via the intake part 2 to the outside of the air cleaner 100. The air introduced into the first space 11S passes through the filter element 4 to be introduced into the second space 12S. The air to be introduced into the second space 12S is filtered by the filter element 4. That is, the filter element 4 removes dust from the air. The air introduced into the second space 12S is discharged outside the case 1 through the exhaust part 3. Thus, clean air is discharged outside the air cleaner 100.

Hereinafter, according to the configuration shown in FIG. 1, the side on which the upstream case 11 is located in the air cleaner 100 is referred to as a "lower side", the side opposite to the "lower side" is described as an "upper side", the side on which the intake part 2 is provided in the air cleaner 100 is referred to as a "front side", the side opposite to the "front side" is described as a "rear side", the left side viewed from the front side of the air cleaner 100 is described as a "left side", and the side opposite to the "left side" is described as a "right side." However, these definitions do not limit the orientation in use of the air cleaner 100. Hereinafter, the left-right direction may be referred to as the "width direction of the air cleaner 100", and the upper-lower direction may be referred to as the "height direction of the air cleaner 100."

The upstream case 11 and the downstream case 12 can each be produced by injection molding of a thermoplastic resin representatively. Examples of the thermoplastic resin may include a polyester resin, a polypropylene resin, and a polyamide resin. If necessary, at least one of the upstream case 11 and the downstream case 12 may be integrally formed or molded with a support stay (not shown).

The upstream case 11 is box-shaped being substantially rectangular in a plan view, having an opening toward the downstream case 12 (or upward). The upstream case 11 has a bottom wall 111 having a bottom surface (inner bottom surface) 111*a* and facing the downstream case 12, a first side wall 112 rising from a peripheral edge of the bottom wall 111, and a first flange 113 extending outward from an upper edge of the first side wall 112. The first side wall 112 has a front wall 112*f* provided with the intake part 2, and a first rear wall 112*b* facing the front wall 112*f* in the front-rear direction.

The intake part 2 has an intake pipe 21 projecting outward from the case 1, and an intake port 22 allowing the intake pipe 21 and the first space 11S to communicate with each other to introduce air into the first space 11S. In this embodiment, the intake pipe 21 extends in the horizontal direction or in substantially parallel with the bottom surface 111*a*. To the intake pipe 21, representatively, an upstream intake duct (not shown) or a silencer (not shown) is coupled.

As shown in FIG. 2, the intake port 22 is disposed at a position deviated to one side from the center of the front wall 112*f*. That is, the intake port 22 is offset from the center of the upstream case 11 in the width direction. Specifically, the intake pipe 21 (the central axis m1 of the intake pipe 21) and the intake port 22 are offset to the left from the center of the front wall 112*f* and are offset from the center X of the filter element 4. The center X of the filter element 4 may be referred to as the center X of the extending surface P4 of the filter element 4 provided in the internal space 1S. Hereinafter, the direction in which the intake port 22 is offset is referred to as a "first offset direction". In this embodiment, the first offset direction is a direction from the right to the left.

As shown in FIG. 1, the downstream case 12 is box-shaped being substantially rectangular in a plan view, having an opening toward the upstream case 11 (or downward). The downstream case 12 has a top wall 121 having a top surface facing the upstream case 11, a second side wall 122 extending downward from a peripheral edge of the top wall 121 to surround the top wall 121, and a second flange 123 extending outward from a lower edge of the second side wall 122.

The second side wall 122 has a second rear wall 122*b* constituting a back surface of the downstream case 12. In an assembled state of the air cleaner 100, the second rear wall 122*b* and the first rear wall 112*b* are in the same plane. That is, a plane containing the second rear wall 122*b* and the first rear wall 112*b* faces the front wall 112*f*. And the second rear wall 122*b* faces the front wall 112*f*, being different in height position from the front wall 112*f*.

The exhaust part 3 has an exhaust pipe 31 projecting outward from the case 1, and an exhaust port 32 allowing the exhaust pipe 31 and the second space 12S to communicate with each other to discharge air from the second space 12S to the outside of the case 1. In this embodiment, the exhaust pipe 31 extends in the horizontal direction or in substantially parallel with the top surface of the top wall 121. To the exhaust pipe 31, representatively, a part such as a downstream duct (not shown) or a throttle body (not shown) is coupled. The upstream intake duct or the silencer is coupled to the intake pipe 21 and the downstream duct or the throttle body is coupled to the exhaust pipe 31, forming an air intake path to an internal combustion engine.

In this embodiment, the exhaust port 32 faces the intake port 22, being different in height position from the intake port 22 in an assembled state of the air cleaner 100. Specifically, as shown in FIG. 2, the exhaust port 32 is arranged substantially on a hypothetical straight line extending from the central axis m1 of the intake pipe 21 (intake port 22) in a plan view or as viewed from a direction perpendicular to the extending direction of the filter element 4. That is, a hypothetical straight line n1 connecting the intake port 22 (the central axis m1 of the intake pipe 21) and the exhaust port 32 (the central axis m2 of the exhaust pipe 31) is coaxial with the central axis m1 of the intake pipe 21. Thus, the straight line n1 is offset from the center X of the filter element 4. Hereinafter, the direction in which the straight line n1 is offset is referred to as a "second offset direction". In this embodiment, the second offset direction is a direction from the right to the left and agrees with the first offset direction.

As shown in FIG. 1, the filter element 4 is a flat member being substantially rectangular in a plan view. The filter element 4 has outside dimensions in a plan view substantially the same as the outside dimensions of the upstream case 11 and those of the downstream case 12. The filter element 4 is supported between the upstream case 11 (the first flange 113) and the downstream case 12 (the second flange 123) so as to be substantially parallel with the bottom wall 111 (the bottom surface 111*a*) of the upstream case 11. That is, the filter element 4 (the extending surface P4) extends in a substantially parallel direction with respect to the central axis m1 of the intake pipe 21 (see FIG. 2) or a direction of an air flow drawn from the intake port 22. In this embodiment, the intake pipe 21 is configured to allow air to flow in a direction substantially parallel with the extending surface P4 of the filter element 4 at or near the intake port 22. The intake pipe 21, however, may or may not be configured to allow air to flow in a direction substantially parallel with the extending surface P4 of the filter element 4 at or near the intake port 22.

The filter element 4 has a filter material 41 and a seal member 42. The filter material 41 is a flat member being substantially rectangular in a plan view. The seal member 42 is disposed to surround the periphery of the filter material 41 in order to prevent leakage of air from a gap between the upstream case 11 and the downstream case 12. The filter element 4 may have a frame capable of supporting the filter material 41 by surrounding the filter material 41.

The filter material 41 representatively includes a pleated paper filter or a pleated nonwoven fabric. Alternatively, the filter material 41 may be an open-cell resin foam or sponge having a flat form. The filter material 41 may be a viscous filter material impregnated with oil or others, or may be a dry filter material having no impregnated oil or others.

As shown in FIG. 1 and FIG. 2, the air cleaner 100 further includes a baffle part (baffle body) 5 that diffuses the air flowing in the first space 11S to introduce the air flow to the filter element 4. The baffle part 5 includes a plurality of widened baffle bodies (widened baffle parts) 50 disposed on the bottom surface 111*a* of the upstream case 11. The widened baffle bodies 50 are integrally formed or molded with the upstream case 11. This enables an efficient production of the upstream case 11. For example, each one of the widened baffle bodies 50 is a plate member having a rib form or a fin form or a member having a bead form.

As shown in FIG. 1, the widened baffle body 50 projects from the bottom surface 111*a* (that is, the surface facing the filter element 4 in the case 1) toward the filter element 4 (the extending surface P4). Hereinafter, the direction in which the widened baffle body 50 projects may be referred to as a "projecting direction". The projecting direction representatively corresponds to a direction removing a core for forming the widened baffle body 50 and the inner periphery of the case 1 in forming the upstream case 11 by injection molding.

As shown in FIG. 2, the widened baffle body 50 extends along the extending surface P4. In this embodiment, the widened baffle body 50 continuously extends to the first side wall 112 along the extending surface P4.

The widened baffle body 50 has a first end (proximal end or upstream end) 50A close to or near the intake port 22 and a second end (distal end or downstream end) 50B opposite to the first end 50A. The second end 50B is connected to the first side wall 112. The second end 50B of the widened baffle body 50, however, may or may not be connected to the first side wall 112. That is, there may be a distance between the widened baffle body 50 and the inner surface of the first side wall 112.

In this embodiment, the widened baffle bodies 50 are arranged in a configuration in which each first end 50A faces the intake port 22. The widened baffle bodies 50 are arranged at intervals with each other in the left-right direction.

The widened baffle bodies 50 are arranged to extend radially from near the intake port 22 as viewed in a direction perpendicular to the extending surface P4. Specifically, the widened baffle bodies 50 are arranged radially or in a radial pattern so that a distance between second ends 50B of adjacent two widened baffle bodies 50 is longer than a distance between first ends 50A thereof. That is, the widened baffle bodies 50 are arranged radially so that distances between adjacent two widened baffle bodies are increased from the intake port 22 toward the exhaust port 32.

The widened baffle bodies 50 include three curved baffle bodies 51 and a linear baffle body 52. The three curved baffle bodies 51 include a first curved baffle body 511, a second curved baffle body 512, and a third curved baffle body 513. The curved baffle body 51 constitutes a curved baffle part.

Each one of the curved baffle bodies 51 is substantially arc-shaped in a plan view and is curved in a direction opposite to the second offset direction. The curved baffle body 51 is curved so as to be away from the straight line n1 connecting the intake port and the exhaust port as the baffle body extends from the intake port toward the exhaust port as viewed in the direction perpendicular to the extending surface P4. That is, as viewed in the direction perpendicular to the extending surface P4 of the filter element 4, the curved baffle body 51 is curved in a direction away from the straight line n1 in a direction from the first end 50A toward the second end 50B, i.e., is curved from the left to the right. In this embodiment, the first curved baffle body 511, the second curved baffle body 512, and the third curved baffle body 513 each have a constant curvature.

The baffle body 51 farthest away from the straight line n1 has a curvature larger than the baffle body 51 nearest the straight line n1 has. Specifically, the third curved baffle body 513 has a curvature larger than the first curved baffle body 511 has. The curved baffle bodies 51 are configured so that a baffle body farther of the baffle bodies away from the straight line n1 has a larger curvature. Specifically, the curvature of each baffle body 51 is set so that a baffle body farther away from the straight line n1 has a larger curvature gradually. In this embodiment, the ascending order in curvature is the first curved baffle body 511, the second curved baffle body 512, and the third curved baffle body 513, and the increasing rate in curvature is constant. That is, the curvature gradually increases in the ascending order of the first curved baffle body 511, the second curved baffle body 512, and the third curved baffle body 513.

The first curved baffle body 511 and the second curved baffle body 512 each extend from the position facing the intake port 22 to the first rear wall 112*b* of the upstream case 11. In this embodiment, the first curved baffle body 511 extends to a position corresponding to the exhaust port 32 in the first rear wall 112*b* of the upstream case 11. And the second curved baffle body 512 extends to or near the right corner of the first rear wall 112*b* of upstream case 11 in substantially parallel with a diagonal of the filter element 4. The third curved baffle body 513 extends from the position facing the intake port 22 to a right-side wall 112*r* of the upstream case 11. Specifically, the third curved baffle body 513 extends to or near the center of the right-side wall 112*r* of the upstream case 11.

The linear baffle body 52 is positioned downstream in the first offset direction among the widened baffle bodies 50. Specifically, the linear baffle body 52 is disposed on the left side of the first curved baffle body 511. The linear baffle body 52 extends substantially linearly in a direction intersecting with the opening surface of the intake port 22 as viewed in the direction perpendicular to the extending surface P4 of the filter element 4; where the opening surface of the intake port 22 extends in the left-right direction and the upper-lower direction. Specifically, the linear baffle body 52 is across the straight line n1 at a slight angle.

Figure 3A:
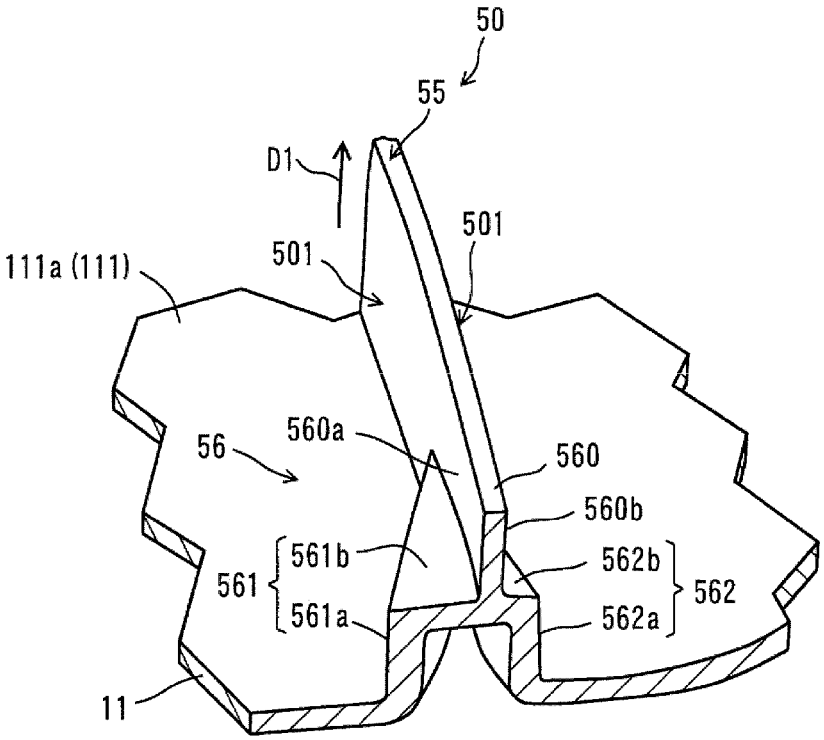
FIG. 3A is a perspective view showing part of a widened baffle body according to the embodiment of this disclosure.
Figure 3B:
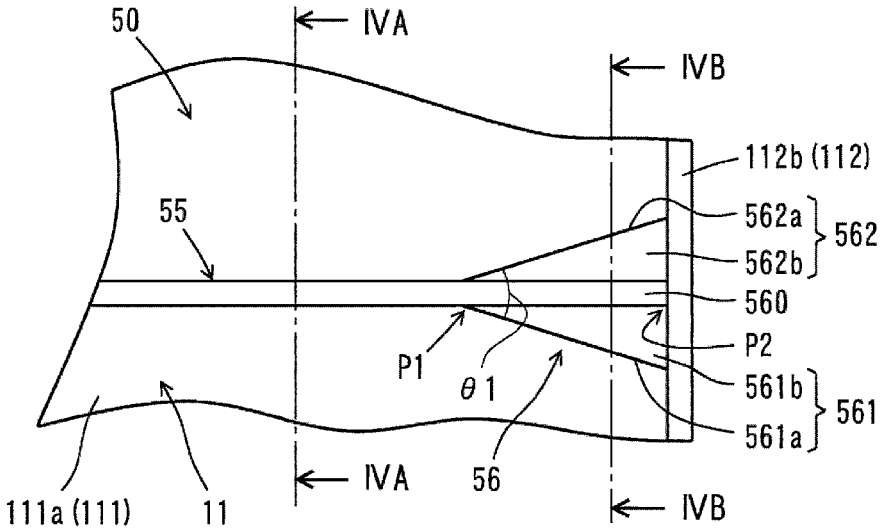
FIG. 3B is a plan view showing part of the widened baffle body according to the embodiment of this disclosure.
Figure 4A:
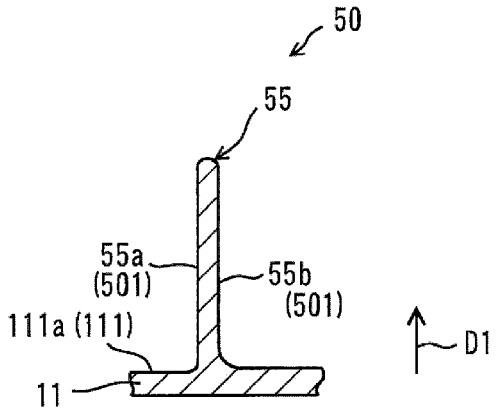
FIG. 4A is a cross-sectional view taken along line IVA-IVA of FIG. 3B.
Figure 4B:
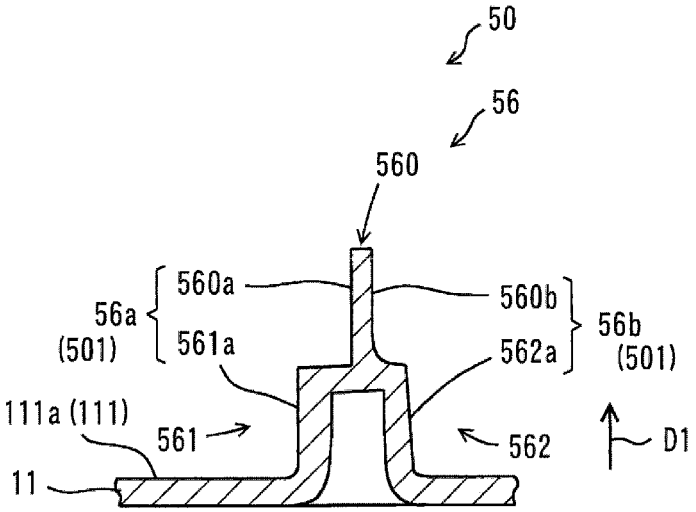
FIG. 4B is a cross-sectional view taken along line IVB-IVB of FIG. 3B.

With reference to FIG. 1 to FIG. 4B, a configuration of the widened baffle body 50 according to this embodiment will further be described. FIG. 3A is a perspective view showing part of the widened baffle body 50 according to this embodiment. FIG. 3B is a plan view (top view) showing part of the widened baffle body 50 according to this embodiment. Each of FIG. 3A and FIG. 3B is a cut-out view of the widened baffle body 50 described with reference to FIG. 2, for example, the first curved baffle body 511, and the bottom surface 111*a*. FIG. 4A is a cross-sectional view taken along line IVA-IVA of FIG. 3B. FIG. 4B is a cross-sectional view taken along line IVB-IVB of FIG. 3B. A direction of an arrow D1 in FIG. 4A and FIG. 4B indicates a projecting direction.

As shown in FIG. 1 to FIG. 3B, the widened baffle body 50 includes a plate or plate-shaped guide section 55 extending along the extending surface P4 of the filter element 4. The guide section 55 has a predetermined or constant width, or a predetermined or constant length in a transverse (or short or lateral) direction of the guide section 55, over a longitudinal (or long) direction of the guide section 55 or a direction in which the guide section 55 extends.

As shown in FIG. 4A, the guide section 55 is solid. The guide section 55 has a first constant-width side surface 55*a* and a second constant-width side surface 55*b*. The first side surface 55*a* extends toward a direction intersecting with the extending surface P4 of the filter element 4 described with reference to FIG. 1. In this embodiment, the first side surface 55*a* extends toward a direction substantially perpendicular to the extending surface P4. The second side surface 55*b* is opposite to the first side surface 55*a* and extends toward a direction intersecting with the extending surface P4. In this embodiment, the first side surface 55*a* and the second side surface 55*b* are substantially parallel with the projecting direction D1. However, the first side surface 55*a* and the second side surface 55*b* may be inclined with respect to the projecting direction D1.

As shown in FIG. 2, the widened baffle body 50 further includes a widened section 56 larger in width, or in length in the transverse direction of the guide section 55, than the guide section 55.

The widened section 56 is coupled or connected to a first end of the guide section 55 (an extending end; an end of the guide section 55 close to the second end 50B of the baffle body 50) and extends along the longitudinal direction of the guide section 55. Specifically, the widened section 56 extends from a starting end or proximal end P1 to a terminal end or distal end P2. The starting end P1 is positioned farther away from the intake port 22 than the first end 50A of the widened baffle body 50, in other words, the starting end P1 is closer to the second end 50B than the first end 50A. The starting end P1 may be positioned farther away from the intake port 22 than a position on the widened baffle body 50 corresponding to the center X of the extending surface P4 of the filter element 4. The position of the starting end P1 in the widened section 56 and the position of the terminal end P2 in the widened section 56, that is, the overall length of the widened section 56, may be set in consideration of a balance with an air-flow resistance of the air cleaner 100. In this embodiment, the starting end P1 is positioned away from the first end 50A by about three-quarters of the overall length of the widened baffle body 50 (the length in the longitudinal direction), in other words, is closer to the second end 50B than the first end 50A, and the terminal end P2 is the second end 50B. That is, the widened section 56 extends over about one-quarter of the overall length of the widened baffle body 50.

As shown in FIG. 3A, the widened section 56 is coupled or connected to the guide section 55 and has a widened base 560 having a width substantially equal to the width of the guide section 55. The widened base 560 extends along the longitudinal direction of the guide section 55 and is provided to stand toward the filter element 4. The upper end of the widened base 560 and the upper end of the guide section 55 may have the same height. The upper end of the widened base 560 and the upper end of the guide section 55 do not necessarily have the same height.

As shown in FIG. 1 to FIG. 3B, the widened section 56 has a width increased at greater distances from the intake port 22. Specifically, as shown in FIG. 3A and FIG. 3B, the widened section 56 further has a first projection 561 and a second projection 562, each projecting from the widened base 560 in the width direction of the widened baffle body 50 or the transverse direction of the guide section 55.

As shown in FIG. 3A, the upper end of the first projection 561 or that of the second projection 562 is different in height position compared to the upper end of the widened base 560. Specifically, the upper end of the first projection 561 or that of the second projection 562 is positioned below the upper end of the widened base 560. That is, the first projection 561 and the second projection 562 project in the width direction from a position lower than the upper end of the widened base 560.

The first projection 561 projects from the widened base 560 toward one side in the width direction of the guide section 55. The first projection 561 has a first projection side surface 561*a* extending from the bottom surface 111*a* toward the filter element 4 and a first projection upper end surface 561*b* extending from an edge of the first projection side surface 561*a* to the widened base 560. The first projection upper end surface 561*b* is substantially parallel with the extending surface P4 of the filter element 4 (see FIG. 2) and is a flat surface. In this embodiment, the first projection upper end surface 561*b* is substantially triangular in a top view and has a width (or a projection length or a distance from the widened base 560) gradually increased at greater distances from the intake port 22.

The second projection 562 projects from the widened base 560 toward the other side in the width direction of the guide section 55. The second projection 562 has a second projection side surface 562*a* extending from the bottom surface 111*a* toward the filter element 4 and a second projection upper end surface 562*b* extending from an edge of the second projection side surface 562*a* to the widened base 560. The second projection upper end surface 562*b* is substantially parallel with the extending surface P4 of the filter element 4 and is a flat surface. In this embodiment, the second projection upper end surface 562*b* is substantially triangular in a top view and has a width (or a projection length or a distance from the widened base 560) gradually increased at greater distances from the intake port 22. The form of the second projection upper end surface 562*b* and that of the first projection upper end surface 561*b* may be symmetric or asymmetric with respect to the widened base 560.

As shown in FIG. 3B, the first projection side surface 561*a* (the first side surface) and the second projection side surface 562*a* (the second side surface) intersect with each other as viewed from the direction perpendicular to the extending surface P4 of the filter element 4 (the upper-lower direction). An angle θ1 between the first projection side surface 561*a* and the second projection side surface 562*a* is, for example, 40°. The angle θ1 may be set in consideration of a balance with an air-flow resistance of the air cleaner 100.

As shown in FIG. 4B, the widened section 56 further has a first widened side surface 56*a* and a second widened side surface 56*b* facing each other with the widened base 560 therebetween. The first widened side surface 56*a* includes the first projection side surface 561*a* and a first base side surface 560*a* of the widened base 560. The second widened side surface 56*b* includes the second projection side surface 562*a* and a second base side surface 560*b* of the widened base 560.

As shown in FIG. 4A and FIG. 4B, the first constant-width side surface 55*a*, the second constant-width side surface 55*b*, the first widened side surface 56*a*, and the second widened side surface 56*b* form a guide surface 501. The air flowing from the intake port 22 into the upstream case 11 flows along the guide surface, being diffused over the space (the first space 11S) surrounded with the guide surface 501, the bottom surface 111*a*, the first side wall 112 (see FIG. 1), and/or others. A corner of the guide surface 501 and the bottom surface 111*a* may be rounded or chamfered in a manner that does not prevent the diffusion of an air flow.

Hereinafter, with reference to FIG. 5, the functions and effects of the air cleaner 100 according to this embodiment will be described.

Figure 5:
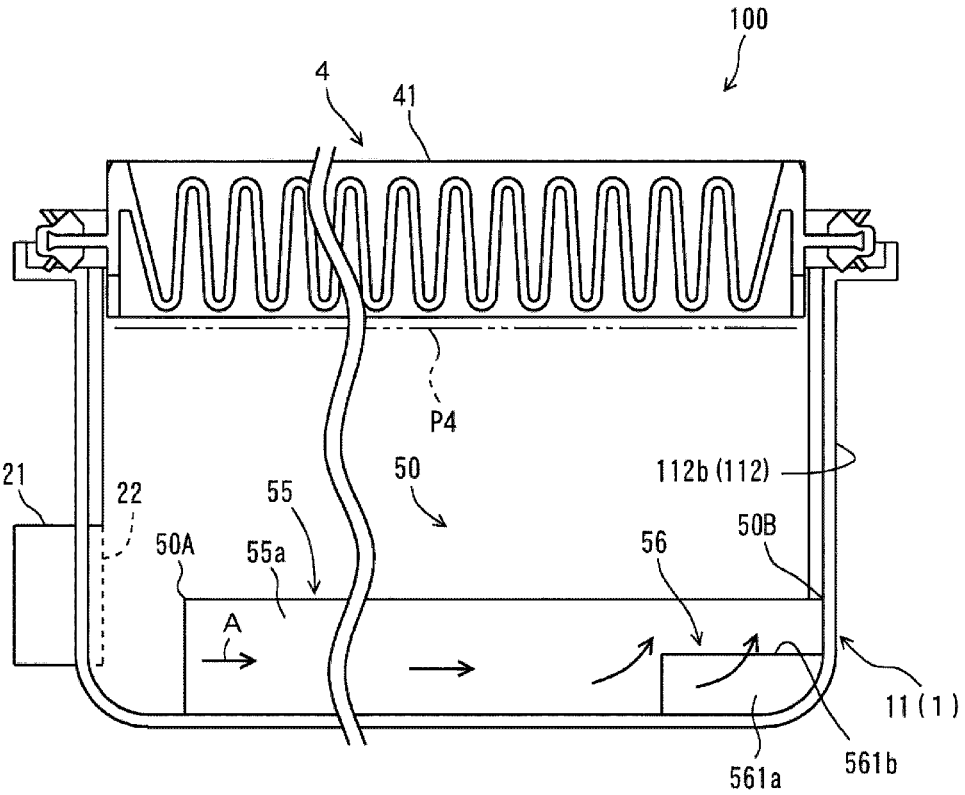
FIG. 5 is a view schematically illustrating an air flow in the air cleaner according to the embodiment of this disclosure.

FIG. 5 is a view schematically illustrating an air flow in the air cleaner 100 according to this embodiment. FIG. 5 is a diagram of the inside of the filter element 4 and the upstream case 11 as viewed from the width direction (the right-hand side) of the air cleaner 100.

As shown in FIG. 5, the air cleaner 100 according to this embodiment includes the widened baffle body 50 (the guide section 55 and the widened section 56) having the guide surface 501. Thus, at or near the intake port 22, most of the air flowing from the intake port 22 flows along the guide section 55, particularly the first constant-width side surface 55*a* and the second constant-width side surface 55*b*. That is, at or near the intake port 22, most of the air flowing from intake port 22 flows in substantially parallel with the extending surface P4 of the filter element 4 as shown in an arrow A and is diffused in substantially parallel with the extending surface P4. Thereafter, some of the air that reaches the widened section 56 is lead to the first projection side surface 561*a* (or the second projection side surface 562*a* (see FIG. 3A)) of the widened section 56, and then flows upward toward the filter element 4 along the first projection side surface 561*a* (or the second projection side surface 562*a*). Thus, the air flowing from the intake port 22 easily flows or tends to flow toward the filter element 4 even in such a configuration as described with reference to FIG. 2, in which the central axis m1 of the intake pipe 21 is substantially parallel with the extending surface P4 of the filter element 4, that is, a configuration including the upstream case 11 having a flat shape.

For example, in a case where the air cleaner has no widened section 56, most of the air flowing from the intake port 22 to the inside the upstream case 11 may fail to flow toward the filter element 4 until it reaches the first side wall 112 and may pass only at or near first side wall 112 of the filter element 4. This may result in localized collection of dust in the filter element 4.

In contrast, the widened section 56 according to this embodiment is disposed at a position closer to the intake port 22 than the first side wall 112, and the air tends to flow toward the filter element 4 in a region closer to the intake port 22 than the first side wall 112. Thus, the filter element 4 is used uniformly. This allows the filter element 4 to collect dust in a homogeneous distribution of dust. Moreover, in this embodiment, the widened section 56 has the starting end P1 set to a position having a greater distance from the intake port 22 than a distance from the center X of the filter element 4 (see FIG. 2). For such a configuration, in a region farther away from the intake port 22 than the center X of the filter element 4, the air even more tends to flow toward the filter element 4. That is, the air even more tends to flow toward the filter element 4 in a wide range around a portion facing the center X of the filter element 4. Thus, the filter element 4 is used more uniformly. This allows the filter element 4 to collect dust in a homogeneous distribution of dust.

As described with reference to FIG. 3B, the first projection side surface 561*a* and the second projection side surface 562*a* intersect with each other, and the first projection 561 and the second projection 562 each has a width increased at greater distances from the intake port 22. In this embodiment, the angle θ1 between the first projection side surface 561*a* and the second projection side surface 562*a* is set to 40°. For such a configuration, the air that reached the widened section 56 is diffused more effectively in substantially parallel with the extending surface P4 with flowing toward the filter element 4, and the air-flow resistance of the filter element 4 can be reduced.

Generally, in a case where the air flow concentrates in a certain region of the filter element 4 to cause localized collection of dust, a pressure increase in the certain region or a pressure loss in the air flow tends to occur. This may result in local deformation of the filter material 4 and/or dust leakage and may shorten the life of the filter element 4. However, according to this embodiment, the concentration of the air flow in a certain region of the filter element 4 is prevented, in other words, the filter element 4 is uniformly used, and the localized collection of dust in the filter element 4 is reduced, in other words, dust is collectable in a wider region of the filter element 4.

This embodiment has been described above. This embodiment prevents localized collection of dust in the filter element 4. That is, the filter element 4 is used uniformly, and this allows the filter element 4 to collect dust in a homogeneous distribution of dust.

Moreover, the air cleaner described in JP 2000-346687 A, in which the opening surface of the intake port is disposed in substantially parallel with the extending direction of the filter element, that is, in which the central axis of the intake port is substantially perpendicular to the extending direction of the filter element, may have a long total height (or a large length in the upper-lower direction). In contrast, according to this embodiment, the extending surface P4 of the filter element 4 intersects with the opening surface of the intake port 22. Such a configuration makes the total height of the air cleaner 100 small. This allows a space-saving design of the air cleaner 100 and a reduced installation space of the air cleaner 100. In some embodiments, the intake pipe 21 extends in substantially parallel with the extending surface P4 of the filter element or the bottom surface 111*a* of the case.

In this embodiment, the intake pipe 21 and the exhaust pipe 31 each project to the outside of the case 1 from a position offset with respect to the center in the width direction (or the left-right direction) of the case 1. This improves a flexibility of layout design compatible to an installation space of the air cleaner 100.

In this embodiment, the air is diffused and is guided or introduced to the filter element 4, even in a case where the straight line n1 connecting the intake port 22 and the exhaust port 32 is offset from the center of the width direction (or the left-right direction) of the case 1. This allows the filter element 4 to collect dust in a homogeneous distribution of dust.

In this embodiment, at least one of the curved baffle bodies 51 is curved to pass through the substantial center X of the filter element 4 in a plan view. Such a configuration facilitates smooth flow of the air to the substantial center X of the filter element 4 and reduces or prevents stagnation of the air in the first space 11S. Thus, in the first space 11S, the air flow is smooth and is efficiently diffused, and this allows the filter element 4 to collect dust in a more homogeneous distribution of dust.

In this embodiment, the curved baffle bodies 51 are arranged radially so that distances between adjacent two baffle bodies are increased in a direction from the intake port 22 toward the exhaust port 32. Such a configuration enables efficient diffusion of the air in the first space 11S.

In this embodiment, the curved baffle bodies 51 are configured so that the baffle body 51 farthest away from the straight line n1 (or the rightmost baffle body 51) has a curvature (or curve) larger than the baffle body 51 nearest the straight line n1 has. Such a configuration enables efficient diffusion of the air.

In this embodiment, the curved baffle bodies 51 are configured so that a baffle body 51 farther away from the straight line n1 has a larger curvature (or curve). Such a configuration enables efficient diffusion of the air.

In this embodiment, the linear baffle body 52 is inclined to a direction opposite to the second offset direction as the linear baffle body 52 extends away from the intake port 22 in a plan view. Such a configuration reduces or prevents the air flow from going straight and allows uniform use of the filter element 4.

In this embodiment, the guide surface 501 is disposed in substantially parallel with the projecting direction D1 (see FIG. 3A, FIG. 4A, and FIG. 4B). Such a configuration enables the air cleaner 100 to have a large gutter-shaped space (between adjacent widened baffle bodies 50) where the air flows. This results in the air flowing smoothly along the guide surface 501 of the widened baffle body 50. This enables efficient diffusion of the air.

Figure 6A:
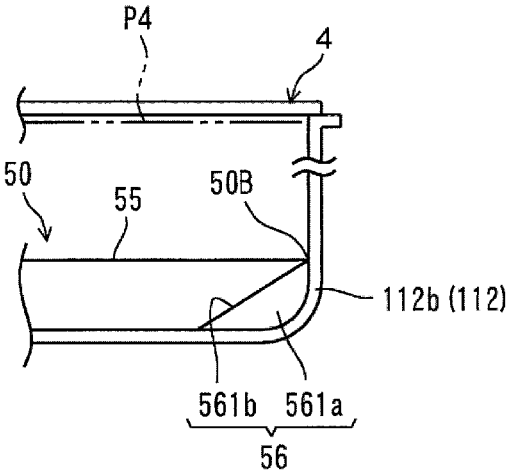
FIG. 6A is a side view showing a first modification of a widened section according to the embodiment of this disclosure.
Figure 6B:
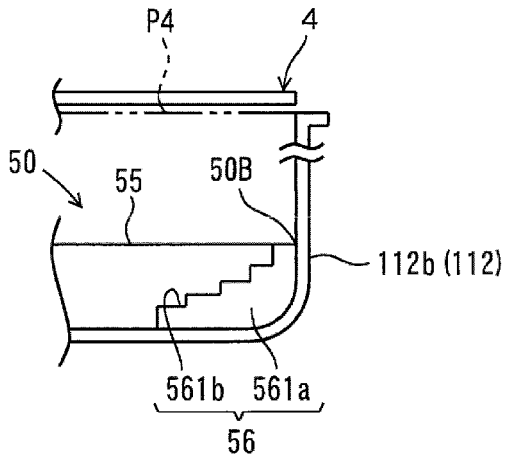
FIG. 6B is a side view showing a second modification of the widened section according to the embodiment of this disclosure.

In this embodiment, the first projection upper end surface 561*b* and the second projection upper end surface 562*b* each are a flat surface in substantially parallel with the extending surface P4. The first projection upper end surface 561*b* (and/or the second projection upper end surface 562*b*) may be a curved surface having a central region bulging or swelling upward or downward and being arc-shaped in a side view. Alternatively, the first projection upper end surface 561*b* (and/or the second projection upper end surface 562*b*) may be a slope that is inclined with respect to the extending surface P4. As shown in FIG. 6A, the first projection upper end surface 561*b* (and/or the second projection upper end surface 562*b*) may be an upward slope that is inclined upward at greater distances from the intake port 22, or that is inclined upward toward the second end 50B. FIG. 6A is a side view showing a first modification of the widened section 56 according to this embodiment. At least one of the first projection upper end surface 561*b* and the second projection upper end surface 562*b* is an upward slope that is inclined upward toward the second end 50B, and thus the air flowing toward the filter element 4 is more diffused. The first projection upper end surface 561*b* and the second projection upper end surface 562*b* each may be stepped that is increased stepwise in height at greater distances from the intake port 22, as shown in FIG. 6B. FIG. 6B is a side view showing a second modification of the widened section 56 according to this embodiment. The first projection upper end surface 561*b* and the second projection upper end surface 562*b* each are increased stepwise in height at greater distances from the intake port 22. Such a configuration allows more diffusion of the air flowing toward the filter element 4.

Figure 7:
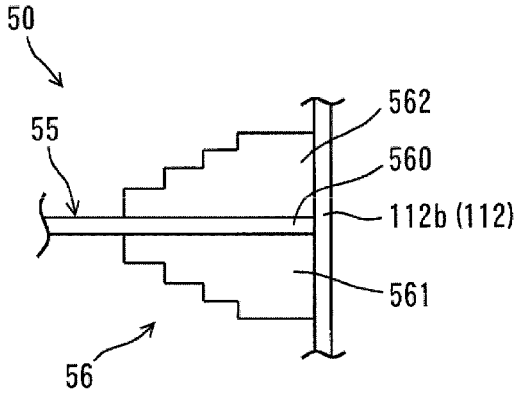
FIG. 7 is a top view showing a third modification of the widened section according to the embodiment of this disclosure.

In this embodiment, the width of the first projection upper end surface 561*b* and that of the second projection upper end surface 562*b* are increased gradually. As shown in FIG. 7, the width of the first projection upper end surface 561*b* and that of the second projection upper end surface 562*b* may be increased stepwise. FIG. 7 is a top view showing a third modification of the widened section 56 according to this embodiment. Both of the width of the first projection upper end surface 561*b* and that of the second projection upper end surface 562*b* may be increased stepwise, or any one thereof may be increased. Such a widened section enables the better regulation or control of the air flow toward the filter element 4.

In this embodiment, as described with reference to FIG. 3B, the angle θ1 between the first projection side surface 561*a* and the second projection side surface 562*a* is set to 40°. The angle θ1 is not limited to 40° and may be 10° to 95°, may be 20° to 93° (for example, 20° to 90°), or may be 30° to 90°. The adjustment of the angle θ1 enables the better regulation of the air flow toward the filter element 4. For example, the orientation of the air can be regulated so that the air flows or is diffused toward the filter element 4 from a position closer to the intake port 22, thus allowing the filter element 4 to collect dust in a homogeneous distribution of dust. The angle θ1 may be constant or may be changed. The angle θ1 may be increased at greater distances from the intake port 22.

Figure 8A:
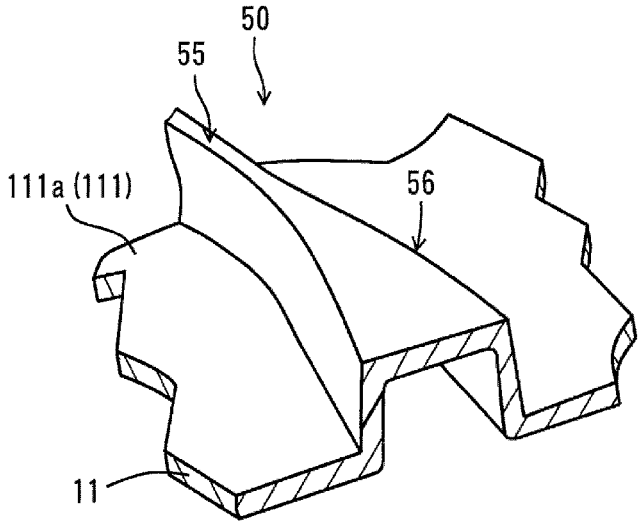
FIG. 8A is a perspective view showing a fourth modification of the widened section according to the embodiment of this disclosure.
Figure 8B:
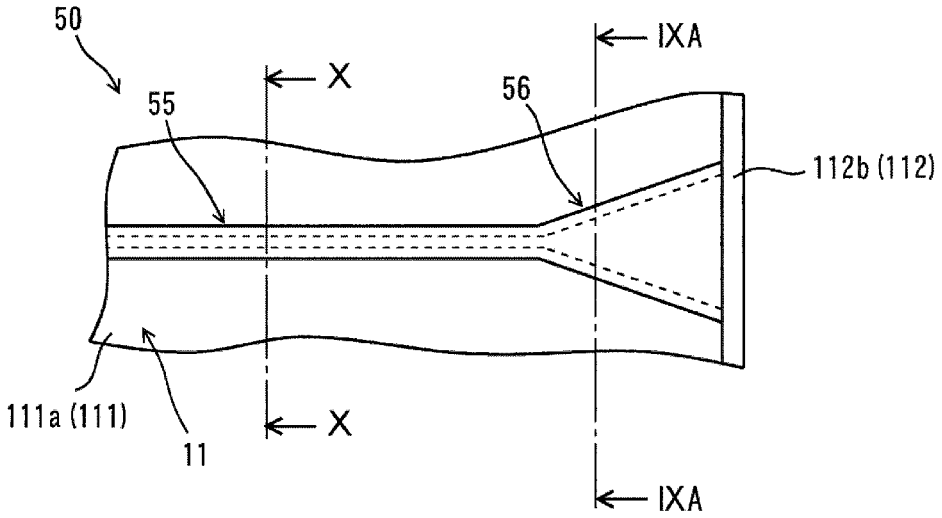
FIG. 8B is a top view showing the fourth modification of the widened section according to the embodiment of this disclosure.

In this embodiment, as described with reference to FIG. 3A, the upper end of the widened base 560 is different in height position from the upper end of the first projection 561 and that of the second projection 562. As shown in FIG. 8A and FIG. 8B, the height or position of the upper end of the widened base 560 may be the same as that of the upper end of the first projection 561 and/or the second projection 562. FIG. 8A is a perspective view showing a fourth modification of the widened section 56 according to this embodiment. FIG. 8B is a top view showing the fourth modification of the widened section 56 according to this embodiment.

Figure 9A:
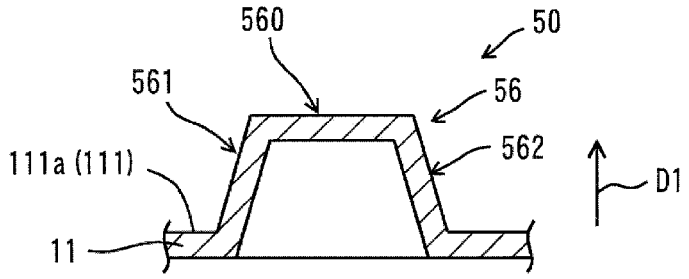
FIG. 9A is a cross-sectional view taken along line IXA-IXA of FIG. 8B.

In this embodiment, the widened base 560 is solid and the first projection 561 and the second projection 562 are hollow in the widened section 56. As shown in FIG. 8A to FIG. 9A, the whole widened section 56, in other words, the widened base 560, the first projection 561, and the second projection 562, may be hollow. FIG. 9A is a cross-sectional view taken along line IXA-IXA of FIG. 8B. A direction of an arrow D1 in FIG. 9A indicates a projecting direction D1.

Figure 9B:
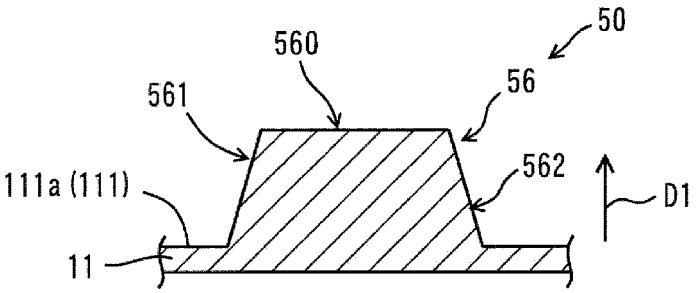
FIG. 9B is a view showing a fifth modification of the widened section according to the embodiment of this disclosure.

As shown in FIG. 9B, the whole widened section 56, in other words, the widened base 560, the first projection 561, and the second projection 562, may be solid. FIG. 9B is a view showing a fifth modification of the widened section 56 according to this embodiment. A direction of an arrow D1 in FIG. 9B indicates a projecting direction D1.

At least part of the widened section 56 may be hollow. For example, the widened base 560 may be hollow. Specifically, part of the widened section 56, for example, the widened base 560, may be hollow, and another part of the widened section 56, for example, the first projection 561 and/or the second projection 562, may be solid. At least part of the widened section 56, for example, the widened base 560, may be in a rib form, or at least part of the widened section 56, for example, the widened base 560, may be in a bead form.

Figure 10:
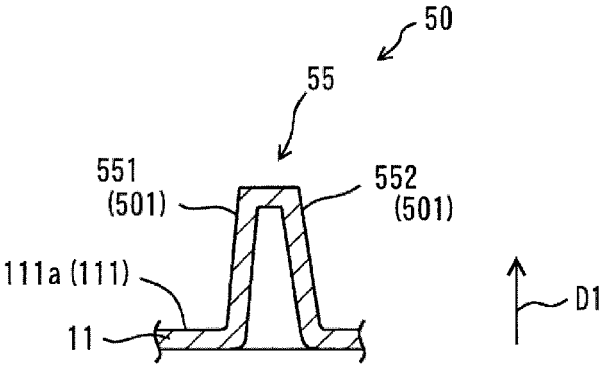
FIG. 10 is a cross-sectional view taken along line X-X of FIG. 8B.

In this embodiment, the guide section 55 is solid. At least part of the guide section 55 is hollow or solid. For example, as shown in FIG. 8B and FIG. 10, the guide section 55 may be hollow. FIG. 10 is a cross-sectional view taken along line X-X of FIG. 8B. A direction of an arrow D1 in FIG. 10 indicates a projecting direction D1.

From the point of view of efficient diffusion of the air, the guide section 55 may be solid rather than hollow. Specifically, in a case where the guide section 55 is solid, the guide section 55 can have a narrower width. When a solid portion of the guide section 55 is provided close to the intake port 2, a larger number of widened baffle bodies 50 can be disposed without decrease in a flow passage space close to or near the intake port 22. Such a guide part enables the air cleaner 100 to be provided with a larger number of widened baffle bodies 50. This results in more effective diffusion of the air.

From the viewpoint of production of the air cleaner 100, both guide section 55 and widened section 56 may be hollow. In a case where both guide section 55 and widened section 56 are hollow, the guide section 55 and the widened section 56 are formable or moldable together with the upstream case 11 and this enables an efficiently increased stiffness of the case 11 and an efficient production of the air cleaner 100.

Figure 11A:
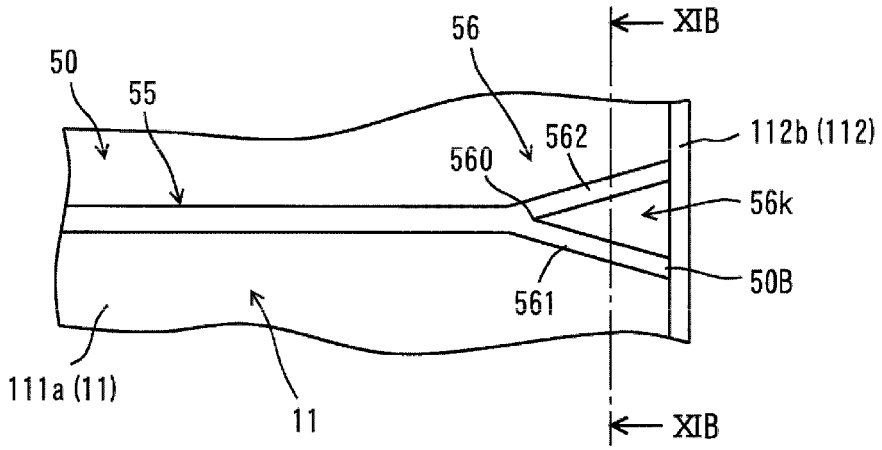
FIG. 11A is a view showing a sixth modification of the widened section according to the embodiment of this disclosure.
Figure 11B:
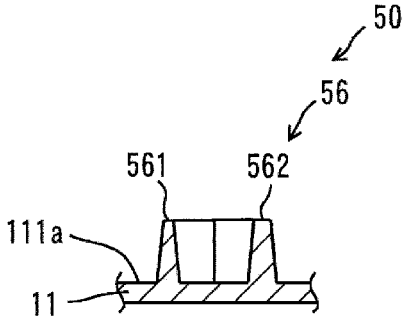
FIG. 11B is a cross-sectional view taken along line XIB-XIB of FIG. 11A.

As shown in FIG. 11A and FIG. 11B, the widened section 56 may branch into multiple near the second end 50B of the widened baffle body 50 as viewed in the direction perpendicular to the extending surface. In an example shown in FIG. 11A and FIG. 11B, the widened section 56 branches into two. Specifically, the widened section 56 may further have at least one notch 56*k* near the second end 50B of the widened baffle body 50 or may branch near the second end 50B. FIG. 11A is a view showing a sixth modification of the widened section 56 according to this embodiment. FIG. 11B is a cross-sectional view taken along line XIB-XIB of FIG. 11A. The notch 56*k* is substantially triangular in a plan view and is provided so as to have a width increased at greater distances from the intake port 22 or at shorter distances from the second end 50B. The form of the notch 56*k* is not limited to a substantially triangular form in a plan view and may be a substantially arc form in a plan view. Such a branched widened section 56 is formable or moldable integrally as a combination of plate-shaped ribs and enables the air cleaner 100 to be produced efficiently.

In this embodiment, the starting end P1 of the widened section 56 is positioned away from the first end 50A by about three-quarters of the overall length of the widened baffle body 50 (the length in the longitudinal direction), in other words, is closer to the second end 50B than the first end 50A. The starting end P1 of the widened section 56 may be positioned away from the first end 50A by one-third or more or by one-half or more of the overall length of the widened baffle body 50. In this embodiment, the widened section 56 extends over about one-quarter of the overall length of the widened baffle body 50. The widened section 56 may extend over one-sixth or more, one-fifth or more, or one-quarter or more, of the overall length of the widened baffle body 50. The position of the starting end P1 or terminal end P2 of the widened section 56 can be changed to regulate the starting position and/or direction of air diffusion. Namely, the position of the starting end P1 or terminal end P2 of the widened section 56 can be changed to control the direction of air or the starting position of air diffusion.

In this embodiment, the widened section 56 has a width increased at greater distances from the intake port 22. The widened section 56 may have a width decreased at greater distances from the intake port 22.

In this embodiment, the starting end P1 of the widened section 56 is positioned farther away from the intake port 22 than the first end 50A of the widened baffle body 50, in other words, the starting end P1 is closer to the second end 50B than the first end 50A. The starting end P1 may be positioned at or near the first end 50A of the widened baffle body 50. In this case, for example, the widened section 56 may be disposed at or near the first end 50A of the widened baffle body 50, and the guide section 55 may be disposed at or near the second end 50B. Alternatively, the guide section 55 may be disposed at or near the first end 50A of the widened baffle body 50, the widened section 56 may be disposed adjacent to the guide section 55, and another guide section 55 may be disposed at or near the second end 50B. In the widened baffle body 50, one or more guide sections 55 and one or more widened sections 56 may be arranged alternately. In a case where the starting end P1 is the first end 50A of the widened baffle body 50, the upper end surface (the first projection upper end surface 561*b* and/or the second projection upper end surface 562*b*) of the widened section 56 may be an upward slope. In a case where the guide sections 55 and the widened sections 56 are arranged alternately, the widened sections 56 may have a width decreased at shorter distances from the guide section 55.

In this embodiment, the terminal end P2 of the widened section 56 is the second end 50B of the widened baffle body 50. The terminal end P2 may be positioned closer to the starting end P1 (the first end 50A) than the second end 50B.

In this embodiment, the widened section 56 has the first projection 561 and the second projection 562. The widened section 56 may be free from the first projection 561 or the second projection 562. In a case where the widened section 56 is free from the first projection 561, the first base side surface 560*a* constitutes the whole of the first widened side surface 56*a*. In a case where the widened section 56 is free from the second projection 562, the second base side surface 560*b* constitutes the whole of the second widened side surface 56*b*.

Figure 12:
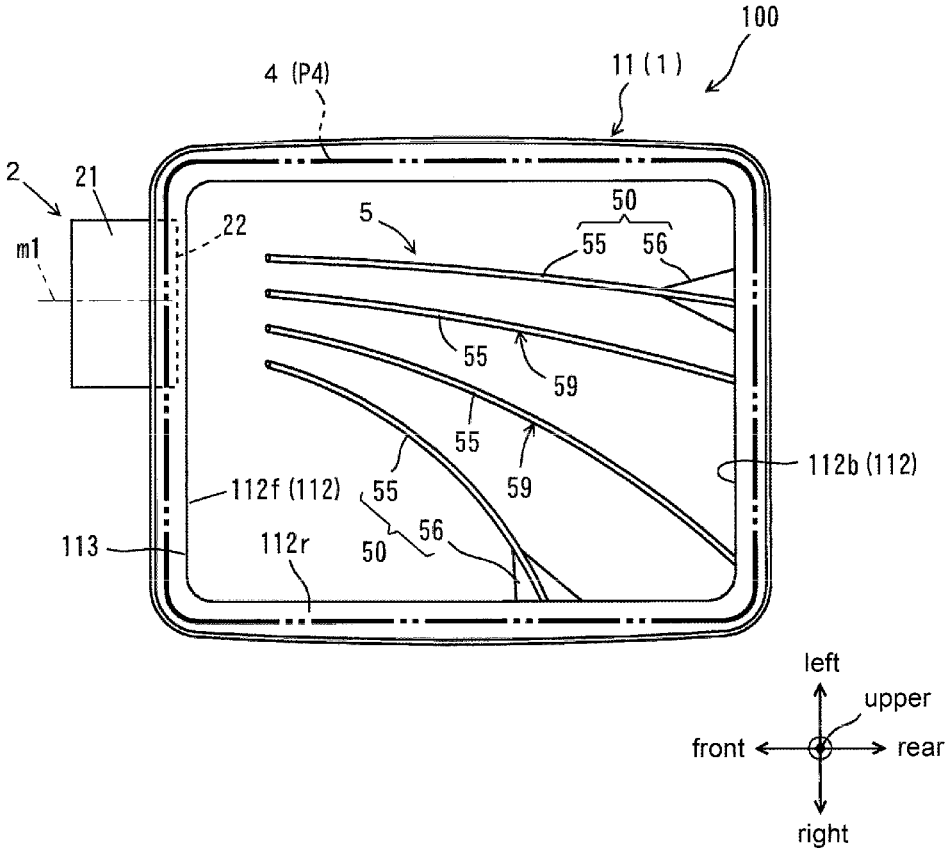
FIG. 12 is a view showing a modification of a baffle part according to the embodiment of this disclosure.

In this embodiment, the baffle part 5 includes only the widened baffle bodies 50. The baffle part 5 includes at least one widened baffle body 50. As shown in FIG. 12, the baffle part 5 may further include a constant-width baffle body (constant-width baffle part) 59 composed of the guide section 55, in addition to the widened baffle body 50. FIG. 12 is a view showing a modification of the baffle part 5 according to the embodiment of this disclosure. The number of widened baffle bodies 50, the number of constant-width baffle bodies 59, the position(s) of the widened baffle body or bodies 50, and the position(s) of the constant-width baffle body or bodies 59 are determined in consideration of a balance with an air-flow resistance of the air cleaner 100.

In this embodiment, each one of the curved baffle bodies 51 has a constant curvature. Each one of the curved baffle bodies 51 may have a curvature gradually increased at greater distances from the straight line n1. For example, each one of the curved baffle bodies 51 has a curvature increased monotonically toward the second end 50B from the first end 50A. Near the intake port 22 (or near the first end 50A), the air introduced into the first space 11S may be diffused insufficiently. In a case where each one of the curved baffle bodies 51 has a curvature gradually increased at greater distances from the straight line n1, the direction of the air flow is gradually changed. This results in sufficient diffusion of the air. Moreover, in a case where each one of the curved baffle bodies 51 has a curvature gradually increased at greater distances from the straight line n1, such curved baffle bodies facilitate smooth flow of the air along each curved baffle body 51. This results in more efficient diffusion of the air.

Each one of the curved baffle bodies 51 may have a sign inversion in the curvature or may be curved only in one direction without a sign inversion in the curvature, that is, may have a curvature with no inflection point. Alternatively, at least one of the curved baffle bodies 51 may have a linear portion. Such a configuration facilitates smooth flow of the air along each curved baffle body 51. This results in more efficient diffusion of the air.

In this embodiment, the linear baffle body 52 is inclined so as to intersect with the straight line n1 at or near the exhaust port. The linear baffle body 52 may be disposed linearly in substantially parallel with the left-hand or right-hand first side wall 112 of the upstream case 11. Such a configuration also results in more efficient diffusion of the air.

In this embodiment, the linear baffle body 52 is across the straight line n1. The linear baffle body 52 may or may not be across the straight line n1.

In this embodiment, the upstream case 11 and the downstream case 12 each are substantially rectangular in a plan view. Each of the upstream case 11 and the downstream case 12 may have any form that enables the air introduced from the intake pipe 21 to be filtered by the filter element 4 and then discharged from the exhaust pipe 31. For example, the forms of the upstream case 11 and the downstream case 12 may be substantially circular, substantially polygonal, or substantially elliptical in a plan view. In such a case, the form of the filter element 4 may be changed corresponding to the forms of the upstream case 11 and the downstream case 12.

In this embodiment, the widened baffle body 50 (the second curved baffle body 512) passes through the substantial center X of the filter element 4 as viewed in the direction perpendicular to the extending surface P4. The widened baffle body 50 does not necessarily need to pass through the substantial center X of the filter element 4.

In this embodiment, the second end 50B of the first curved baffle body 511 is positioned at or near the exhaust port 32 as viewed in the direction perpendicular to the extending surface P4. The second end 50B may or may not be positioned at or near the exhaust port 32.

In this embodiment, an example having three curved baffle bodies 51 is shown. The number of curved baffle bodies 51 is at least one and may be one, two, or four or more. For example, the number of curved baffle bodies 51 may be two to five or three to four. In a case where the number of curved baffle bodies 51 is one, the curved baffle body 51 may be across the straight line n1. Moreover, the linear baffle body 52 is not necessarily needed. Alternatively, the number of linear baffle bodies 52 is not limited to one and may be two or more. The number of curved baffle bodies 51 and that of linear baffle bodies 52 may be changed, for example, according to at least one selected from the group consisting of the size of the air cleaner 100, the position of the intake port 22, and the position of the exhaust port 32.

In this embodiment, the guide section 55 and/or the widened section 56 (the widened base 560) has a constant total height. The guide section 55 and/or the widened section 56 may or may not have a constant total height. For example, the guide section 55 and/or the widened section 56 may have a larger total height at greater distances from the intake port 22. The guide section 55 and/or the widened section 56 may have a regular or irregular total height so as to be in a regular or irregular wave form in a side view.

In this embodiment, the first ends 50A of the widened baffle bodies 50 are positioned at substantially regular intervals in the width direction. The first ends 50A of the widened baffle bodies 50 may or may not be positioned at substantially regular intervals. For example, the widened baffle bodies 50 may be arranged so that the interval between adjacent two baffle bodies is larger at greater distances from the straight line n1.

In this embodiment, described is a configuration in which the guide surface 501 is substantially parallel with the projecting direction D1. The guide surface 501 may be inclined with respect to the projecting direction D1 in a range that does not prevent the diffusion of the air.

In this embodiment, the guide section 55 is disposed continuously along the extending surface P4. It is not necessary that the guide section 55 continuously extend. The guide section 55 may be formed discontinuously along the extending surface P4. In such a configuration, the guide section 55 has a plurality of baffle pieces disposed regularly or irregularly along the extending surface P4. The baffle pieces may be uniform or non-uniform in size. Moreover, the interval between adjacent baffle pieces may or may not be constant.

In this embodiment, the straight line n1 connecting the intake port 22 and the exhaust port 32 is offset from the center X of the filter element 4. The straight line n1 may pass through the center X of the filter element 4. In such a case, the curved baffle body 51 may be disposed line-symmetrically with respect to the straight line n1.

In this embodiment, described is a configuration in which the exhaust port 32 is disposed at the second rear wall 122*b*, and the second rear wall 122*b* is parallel with the front wall 112*f* provided with the intake port 22. The wall at which the exhaust port 32 is disposed is not limited to the second rear wall 122*b*. For example, the exhaust port 32 may be disposed at a wall having a surface intersecting with the front wall 112*f*, for example, a right-side wall or a left-side wall.

Exemplary embodiments of this disclosure have been described above. However, this disclosure is not limited to the above-described embodiments, and can be implemented in various embodiments without departing from the scope thereof. The forms, shapes, and others shown in the above-described embodiments are only exemplary and not restrictive, and various modifications can be made without substantially departing from the effects of this disclosure.

For example, in the above embodiment of this disclosure, a configuration in which the air cleaner 100 includes two cases 1 independently formed (the upstream case 11 and the downstream case 12) and the filter element 4 supported between the two cases 1 is described as an example. The air cleaner 100 is not limited to this configuration and may have any configuration in which the filter element 4 can partition the internal space 1S into the first space 11S and the second space 12S. For example, the air cleaner 100 may include the filter element 4 put into a slit that is provided in a single or integrated case 1 and that extends in a width direction of the case 1.

In the above embodiment of this disclosure, a configuration in which the widened baffle body 50 is integrally formed or molded with the upstream case 11 is described. The widened baffle body 50 may be provided separately from the upstream case 11. Specifically, the widened baffle body 50 may be produced separately from the upstream case 11 and attached to the upstream case 11. The widened baffle body 50 may be attached by, for example, bonding or welding such as vibration welding.

The air cleaner 100 may include other members such as a resonance silencer (a resonator or a side branch). The resonance silencer may be provided integrally with the air cleaner. Alternatively, the inside of the upstream case 11 or the downstream case 12 may be partitioned so that part of the inside can serve as the resonance silencer. In this case, the widened baffle body 50 according to the above embodiment of this disclosure may serve as part of a partition.

The air cleaner 100 according to this disclosure is applied to an internal combustion engine for motor cars. The air cleaner 100 is also successfully applied to not only the internal combustion engine for motor cars but also various applications, for example, internal combustion engines for motorcycles, housing equipment, household appliances, power generation equipment, and various industrial equipment.

According to this disclosure, the air diffused by the baffle part is uniformly introduced to the filter element and is filtered through the filter element. This allows the filter element to collect dust in a homogeneous distribution of dust.

The air cleaner according to this disclosure is applicable to internal combustion engines for motor vehicles such as motor cars and motorcycles, air conditioners, fuel cells, and air cooling systems for cells and electronic circuits.

This disclosure provides illustrative, non-limiting aspects as follows.

In a first aspect, there is provided an air cleaner including a case having an internal space, a filter element capable of partitioning the internal space into a first space and a second space, an intake port that introduces an air into the first space therethrough, an exhaust port that discharges an air from the second space, and at least one baffle part that projects toward the filter element from an inner surface of the case and diffuses the air introduced into the first space and introduces the air to the filter element. The baffle part includes a widened baffle part, and the widened baffle part includes a guide section extending along an extending surface of the filter element and a widened section larger in width than the guide section.

In a second aspect, there is provided the air cleaner according to the first aspect, wherein the widened section is disposed away from a center of the filter element and farther away from the intake port as viewed in a direction perpendicular to the extending surface.

In a third aspect, there is provided the air cleaner according to the first or the second aspect, wherein the widened section has a width increased at a greater distance from the intake port as viewed in a direction perpendicular to the extending surface.

In a fourth aspect, there is provided the air cleaner according to any one of the first to the third aspects, wherein the widened section has a first side surface extending toward a direction intersecting with the extending surface and a second side surface opposite to the first side surface, and the first side surface and the second side surface intersect with each other.

In a fifth aspect, there is provided the air cleaner according to the fourth aspect, wherein an angle between the first side surface and the second side surface is 20° to 90°.

In a sixth aspect, there is provided the air cleaner according to any one of the first to the fifth aspects, wherein the widened section branches as viewed in a direction perpendicular to the extending surface.

In a seventh aspect, there is provided the air cleaner according to any one of the first to the sixth aspects, wherein the widened baffle part includes a curved baffle part, and the curved baffle part is curved so as to be away from a hypothetical straight line connecting the intake port and the exhaust port as the curved baffle part extends from the intake port toward the exhaust port as viewed in a direction perpendicular to the extending surface.

In an eighth aspect, there is provided the air cleaner according to any one of the first to the seventh aspects, wherein the baffle part further includes a constant-width baffle part having a constant width.

In a ninth aspect, there is provided the air cleaner according to any one of the first to the eighth aspects, wherein at least part of the guide section, at least part of the widened section, or both is hollow or solid.

In a tenth aspect, there is provided the air cleaner according to any one of the first to the ninth aspects, wherein at least part of the guide section, at least part of the widened section, or both is in a rib form or a bead form.

What is claimed is:

1. An air cleaner comprising:

a case having an internal space, a filter element capable of partitioning the internal space into a first space and a second space, an intake port being configured to introduce an air into the first space therethrough, an exhaust port being configured to discharge an air from the second space, and at least one baffle part projecting toward the filter element from an inner surface of the case, the baffle part being configured to diffuse the air introduced into the first space and introduce the air to the filter element, the baffle part comprising a widened baffle part, and the widened baffle part comprising a guide section extending along an extending surface of the filter element and a widened section larger in width than the guide section, wherein the guide section is positioned closer to the intake port than the widened section; and wherein the widened section has a width increased at a greater distance from the intake port as viewed in a direction perpendicular to the extending surface.

2. The air cleaner according to claim 1, wherein the widened section is disposed away from a center of the filter element and farther away from the intake port as viewed in a direction perpendicular to the extending surface.

3. The air cleaner according to claim 1, wherein the widened section has a first side surface extending toward a direction intersecting with the extending surface and a second side surface opposite to the first side surface, and the first side surface and the second side surface intersect with each other.

4. The air cleaner according to claim 3, wherein an angle between the first side surface and the second side surface is 20° to 90°.

5. The air cleaner according to claim 1, wherein the widened section branches as viewed in a direction perpendicular to the extending surface.

6. The air cleaner according to claim 1, wherein the widened baffle part comprises a curved baffle part, and the curved baffle part is curved so as to be away from a hypothetical straight line connecting the intake port and the exhaust port as the curved baffle part extends from the intake port toward the exhaust port as viewed in a direction perpendicular to the extending surface.

7. The air cleaner according to claim 1, wherein the baffle part further comprises a constant-width baffle part having a constant width.

8. The air cleaner according to claim 1, wherein at least part of the guide section, at least part of the widened section, or both is hollow or solid.

9. The air cleaner according to claim 1, wherein at least part of the guide section, at least part of the widened section, or both is in a rib form or a bead form.

* * * * *